United States Patent [19]

Clausing

[11] 4,218,596

[45] Aug. 19, 1980

[54] CIRCUIT BREAKER MOLDED HOUSING

[75] Inventor: Challiss I. Clausing, Marlton, N.J.

[73] Assignee: Gould Inc., Rolling Meadows, Ill.

[21] Appl. No.: 869,589

[22] Filed: Jan. 16, 1978

[51] Int. Cl.[2] ..... H01H 9/30

[52] U.S. Cl. ..... 200/144 R; 200/148 C; 200/304; 200/306

[58] Field of Search ..... 200/144 R, 146 R, 148 C, 200/293, 50 AA, 304, 306

[56] References Cited

U.S. PATENT DOCUMENTS

| | | | |
|---|---|---|---|
| 3,189,714 | 6/1965 | Bonnard et al. | 200/293 |
| 3,684,849 | 8/1972 | Zubaty | 200/144 R |

*Primary Examiner*—J. V. Truhe
*Assistant Examiner*—Morris Ginsburg
*Attorney, Agent, or Firm*—Ostrolenk, Faber, Gerb & Soffen

[57] ABSTRACT

A unitary molded housing for a multipole high capacity circuit breaker wherein the housing may receive and support modules of different current carrying and interrupting capacity. The molded housing has vertical side walls and parallel vertical integral interphase barriers as well as a back wall and top wall. Disconnect contact bars are mounted through the back wall and support and are connected to circuit breaker contact structures at the front side of the back wall. Recesses which receive the arc extinguisher structure are formed by adjacent vertical walls and the top wall. The interior of the top wall forms a baffle or guide on which arc gases vented from the arc extinguisher impinge and are guided to the vertical walls and the spaces between the said walls and the arc extinguishers.

9 Claims, 13 Drawing Figures

210
432
181
421
420
441
442
435
446
436
426
120
110
110c
110d

FIG. 10
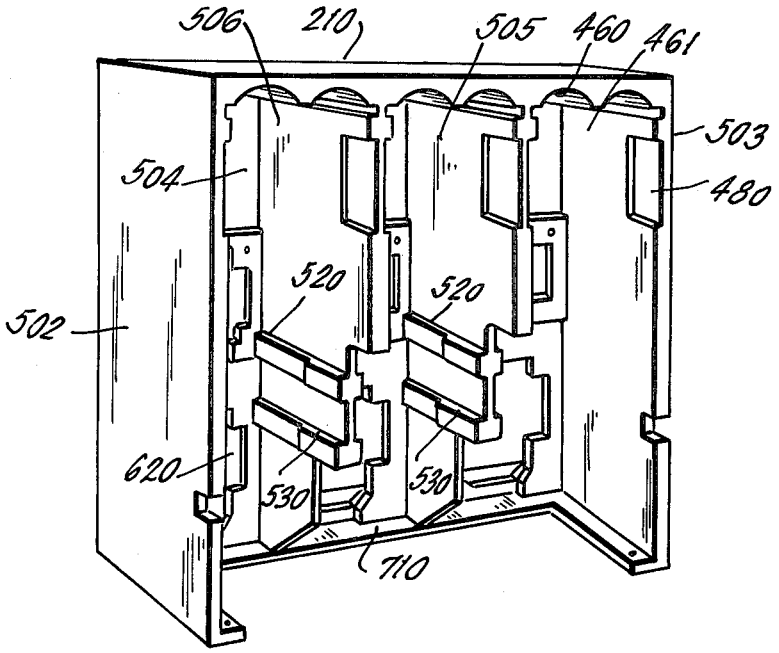
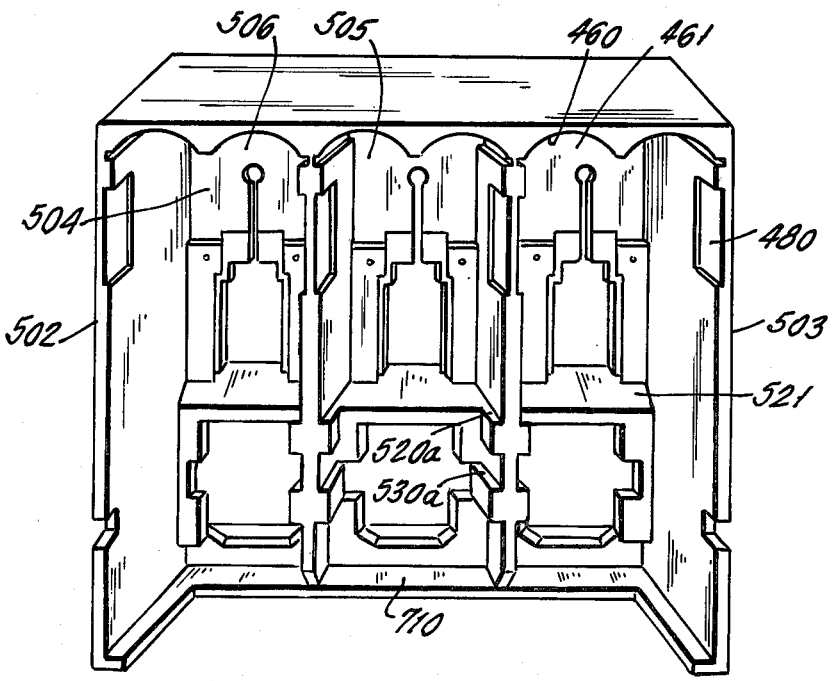
FIG. 11

FIG. 12
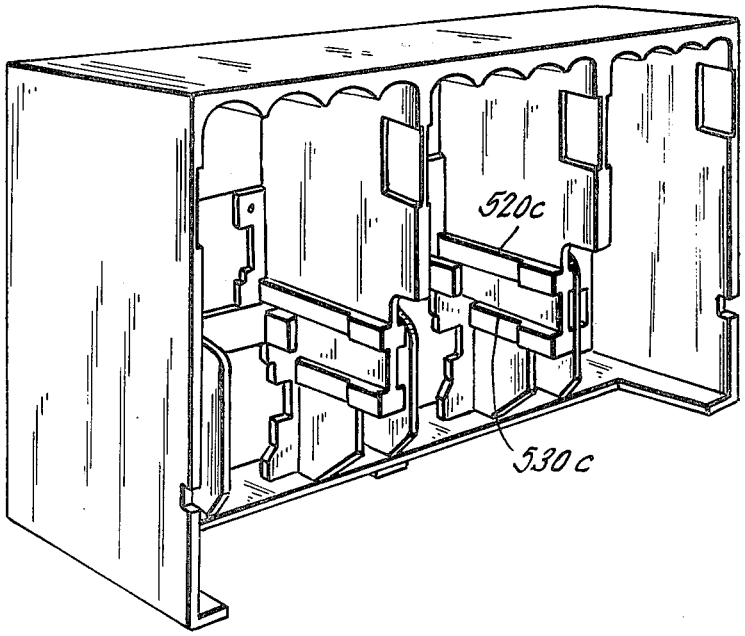
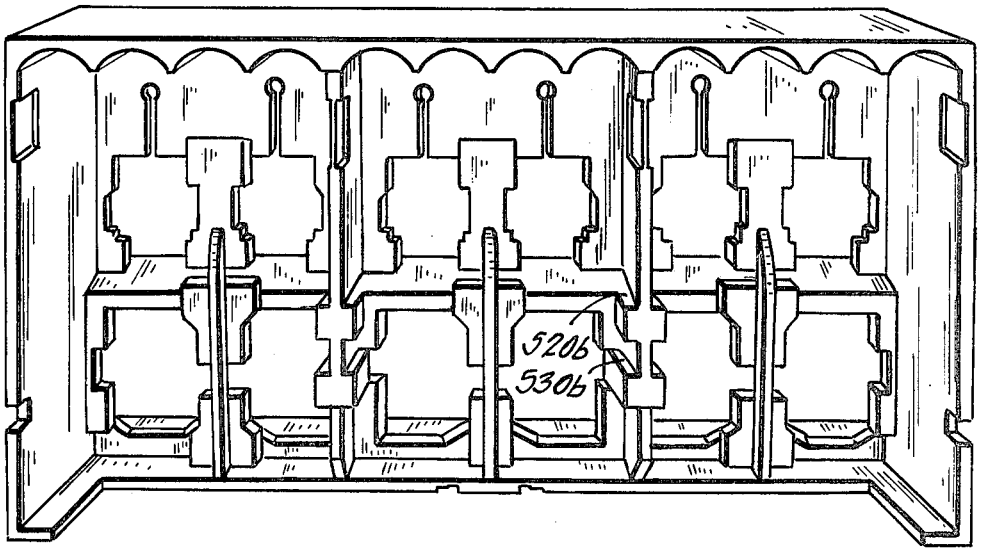
FIG. 13

CIRCUIT BREAKER MOLDED HOUSING

The present invention relates to a housing for circuit breakers and more particularly to a molded housing for relatively high voltage and current circuit breakers.

Heretofore, molded housings have been used for small circuit breakers and switchgear of limited capacity and limited requirements. The application of molded housings for circuit breakers and switchgear intended to carry high voltage and current has heretofore been thought to be difficult or impossible owing to the fact that such a housing might not necessarily be able to withstand the stresses which occur in the case of high capacity circuit breakers. Circuit breakers intended to carry current in normal load conditions from 800 to 2,000 amperes at various voltages, say, of the order of 660 volts, previously required appropriate frameworks instead of a single molding or housing. In addition, circuit breakers which are designed to be closed by a stored energy spring system are subject to various mechanical forces not heretofore thought compatible with the utilization of a molded housing.

In the present invention, however, the object is to combine the structural, insulating and interrupting functions into a single one-piece molded housing. The utilization of the molded housing dispenses with a conventional metal shell which supports an insulating piece or plurality of such pieces. The molded housing supports current-carrying parts and provides attaching points for mechanism and drawout parts. The molding also surrounds and provides a baffle for an arc extinguisher so that the molding is used to contain the arc products rather than utilizing a superstructure on the arc extinguisher itself.

One of the objects of the present invention is, therefore, the provision of a molded casing for a circuit breaker in which current-carrying parts are attached to the various supports carried by the molded casing. The jackshaft which drives all of the contacts is carried by supports anchored in the molding and the mechanism for operating the same depends from these same supports. The top of the molding surrounds each arc chute so that arc products impinge on the interior of the molding and are then guided around the sides of the chute by the molding.

Another object of the invention, therefore, is the utilization of a single molding to replace a plurality of conventional structural circuit breaker support members.

A further object of the present invention is, by the utilization of a single molding, to reduce ground exposure of electrical parts.

While molded cases for circuit breakers generally are well known, the molded case of the present invention maintains ready accessibility to inspect and repair arc extinguishers, contacts, and driving mechanisms, which has heretofore been either difficult or impossible in the ordinary molded case breakers.

The foregoing and many other objects of the present invention will become apparent in the following description and drawings in which.

Figure 3:
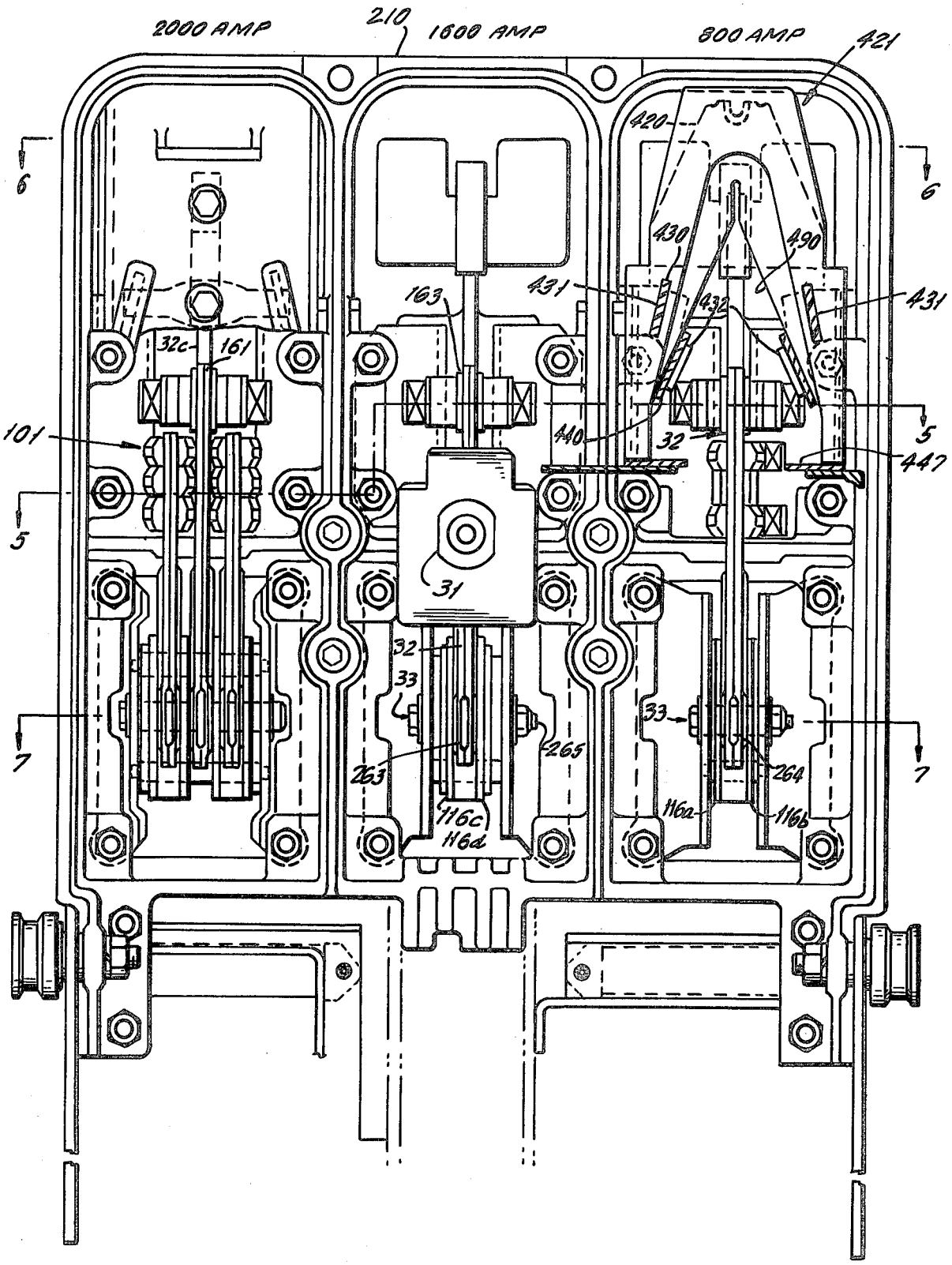

FIG. 3 is a front view of a plurality of different types of circuit breaker poles assembled together into a single housing for the purpose only, of demonstrating that circuit breaker poles of varying capacity can be used within the same geometric outline of the circuit breaker. All poles of any one circuit breaker will be of the same rating; in this case, the three different types of poles are shown only to demonstrate the versatility of the present device.

Figure 4:
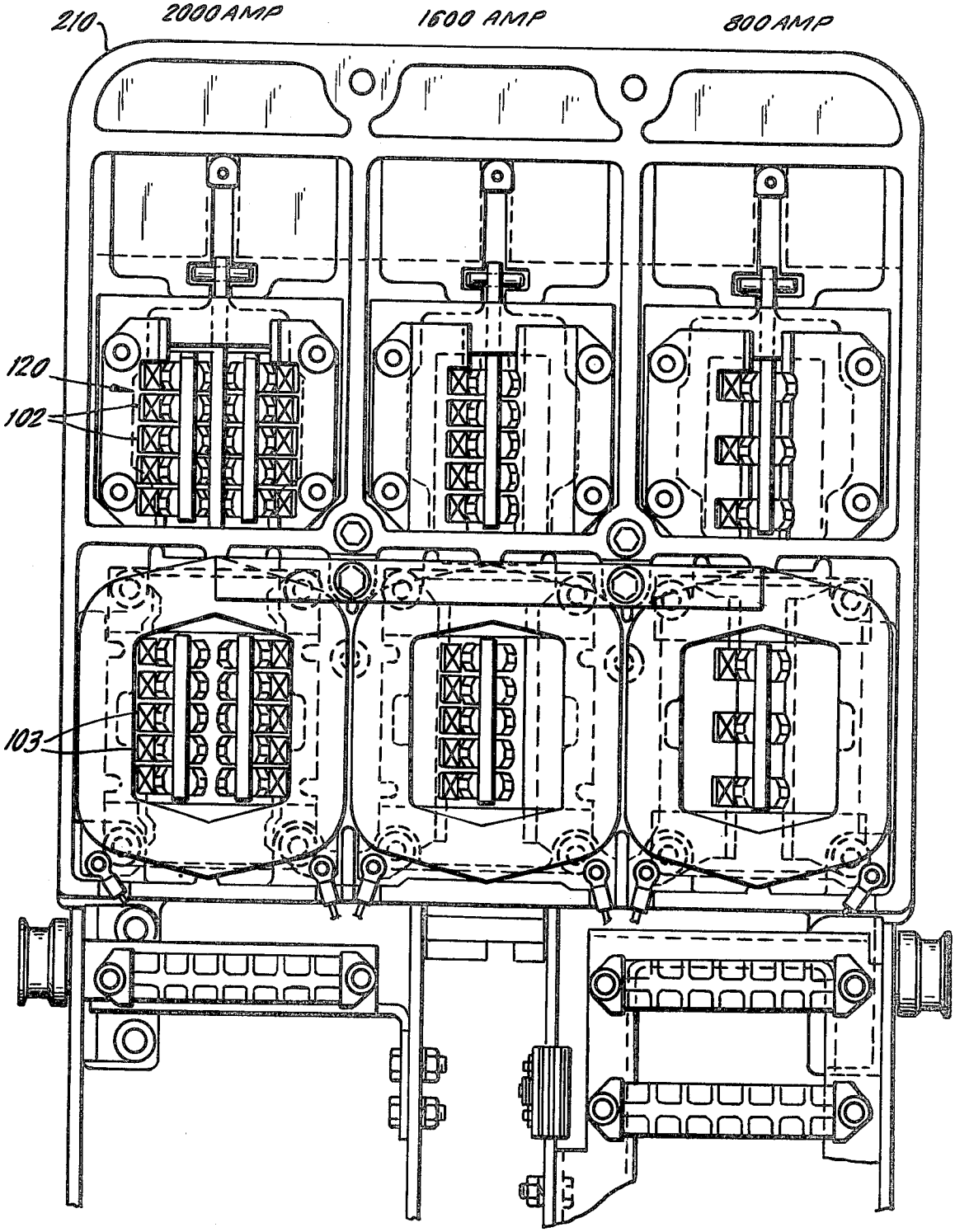

FIG. 4 is a rear view of a structure similar to that of FIG. 3.

Figure 5:
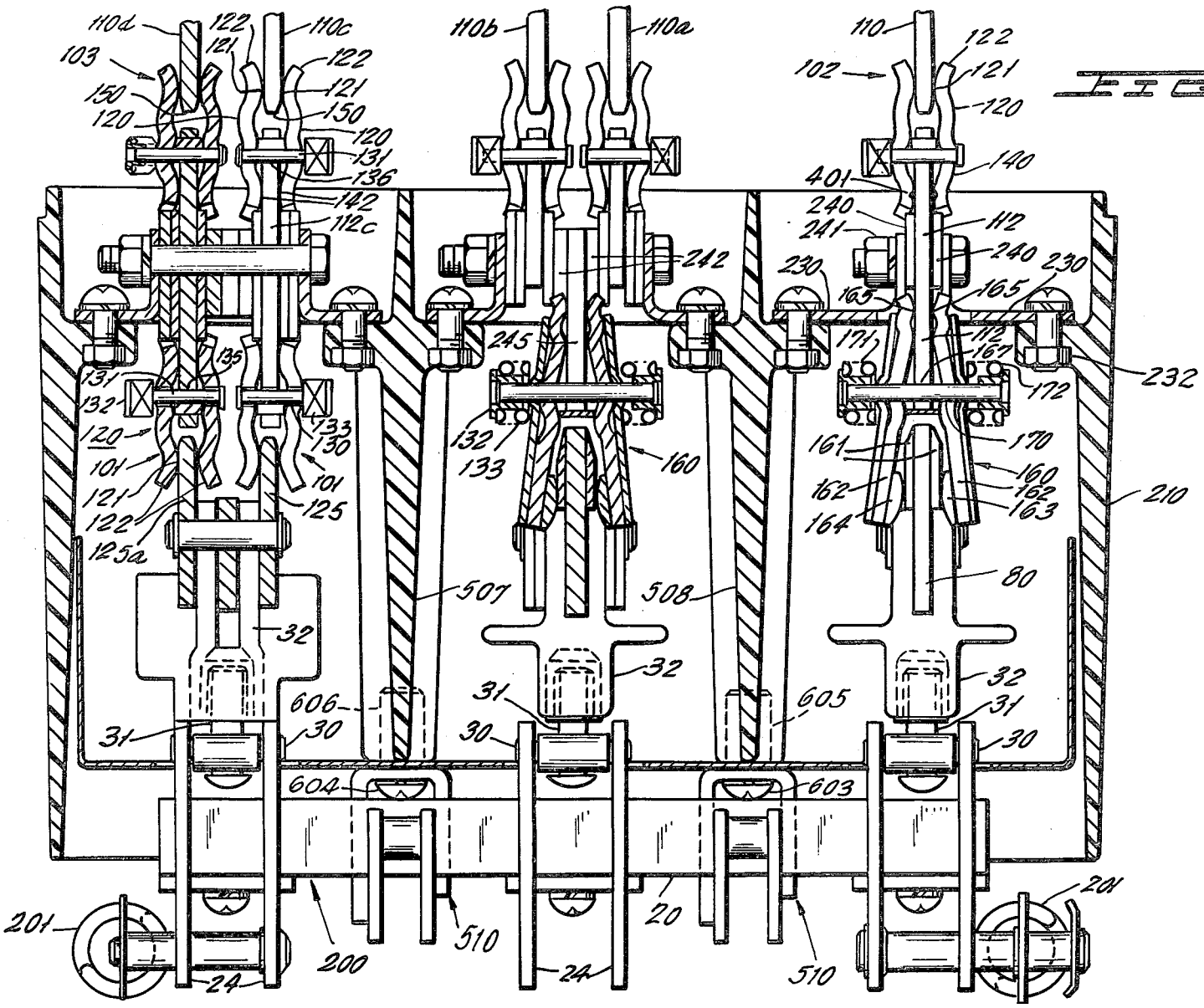

FIG. 5 is a top view partly in section taken from line 5—5 of FIG. 3 looking in the direction of the arrows.

Figure 6:
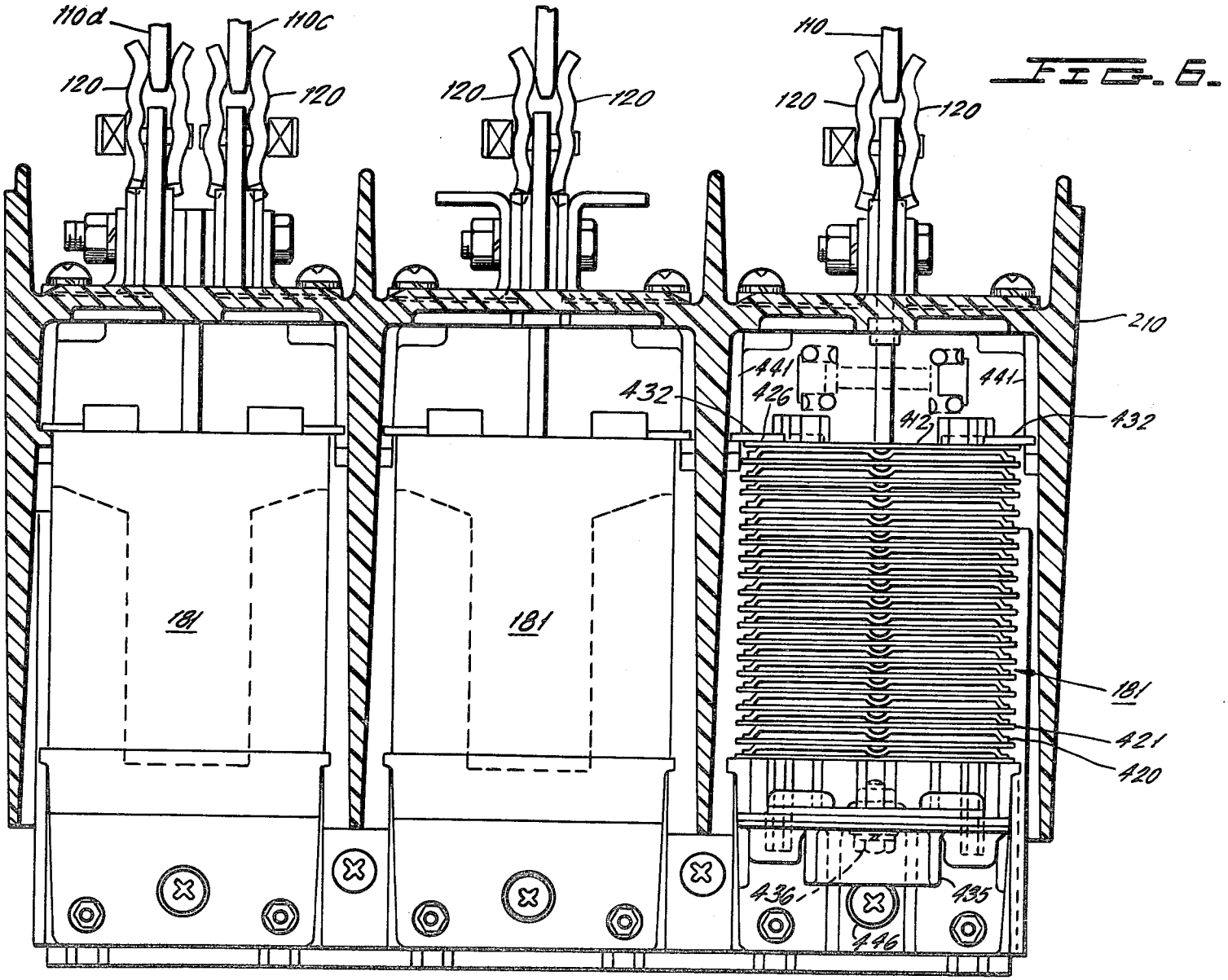

FIG. 6 is another top view partly in section taken from line 6—6 of FIG. 3 looking in the direction of the arrows.

Figure 7:
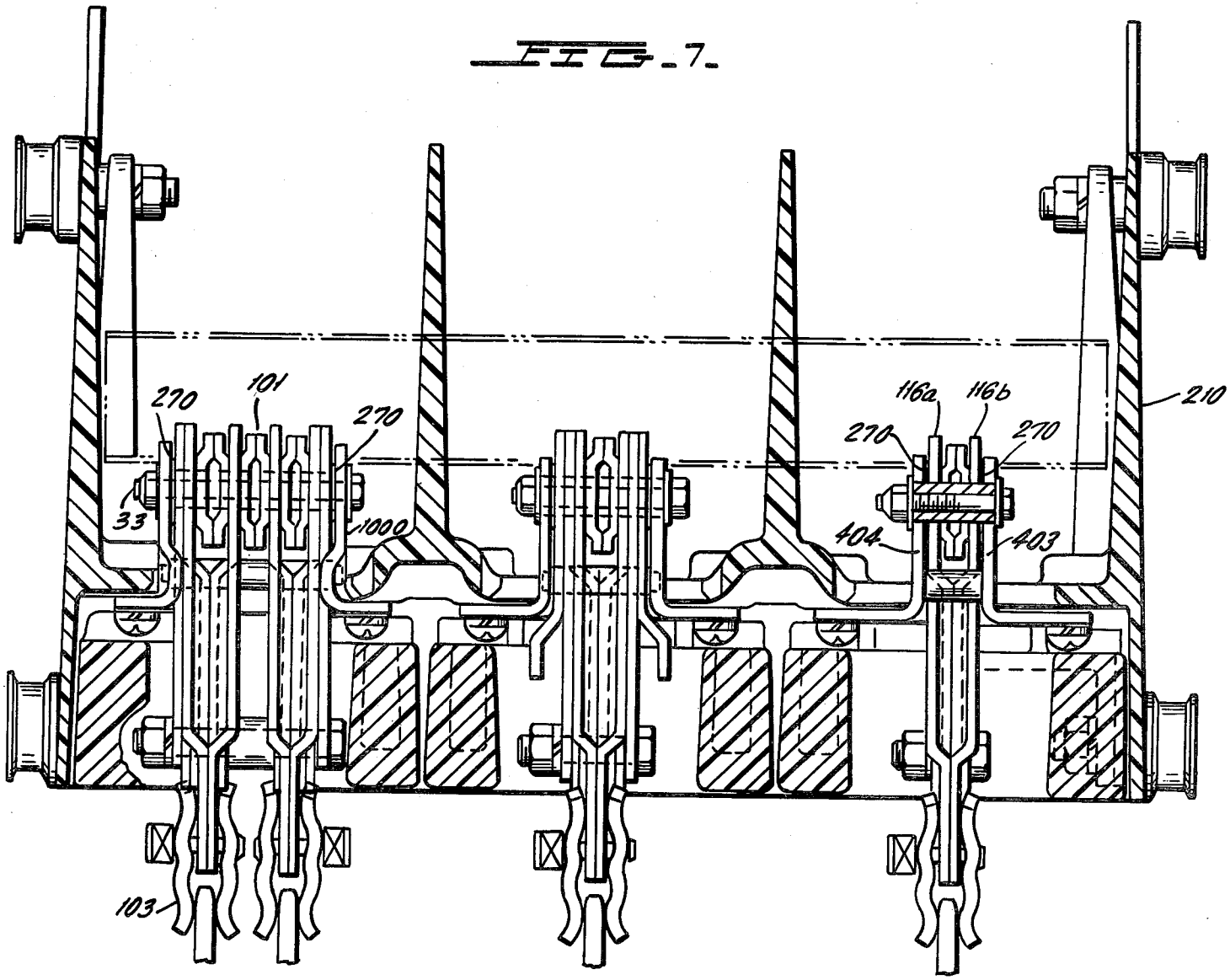

FIG. 7 is a horizontal view partly in section taken from line 7—7 of FIG. 3 looking in the direction of the arrows.

Figure 8:
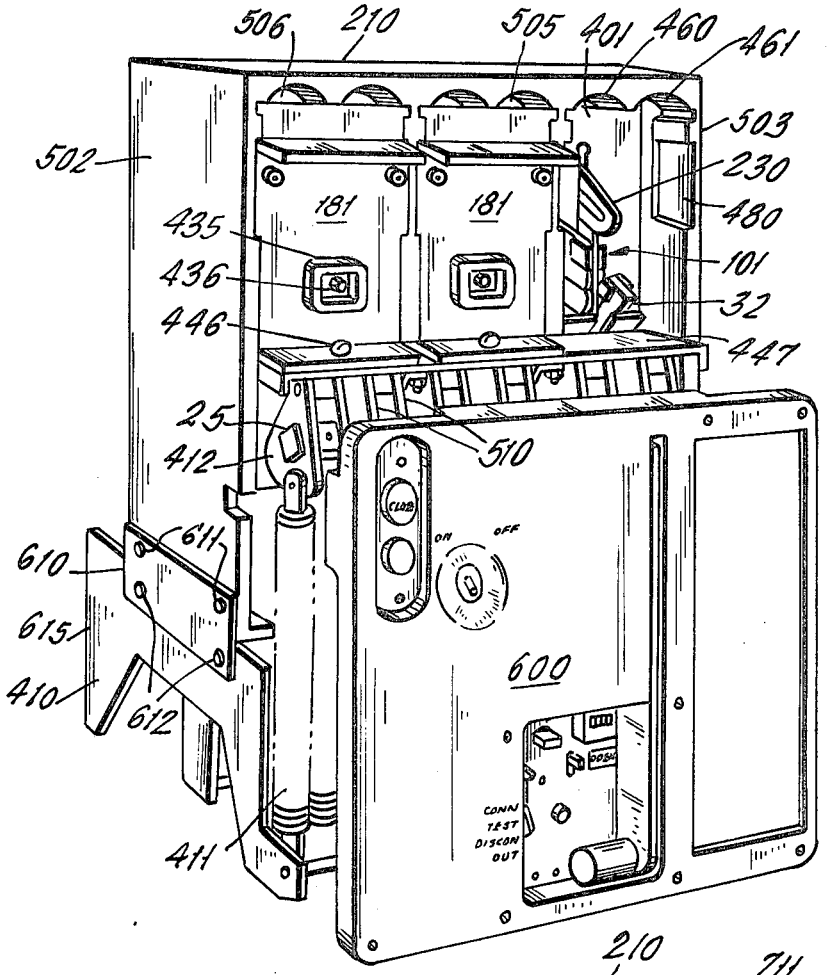

FIG. 8 is a view in perspective of a complete circuit breaker showing the molded casing in use, the view being taken from the front of the breaker with one of the arc extinguishers removed and the front panel also removed.

Figure 9:
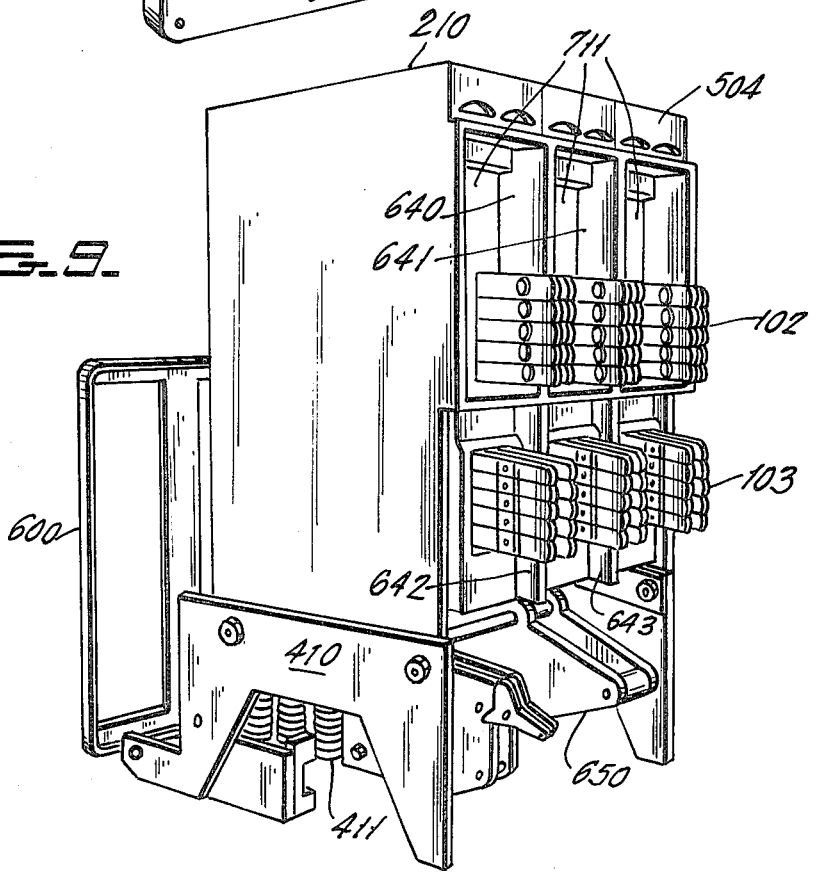

FIG. 9 is a rear view of the molded case structure of the circuit breaker of the present invention.

FIG. 10 is a front view in perspective of the molded casing support structure for the circuit breaker.

FIG. 11 is another front view in perspective of the molded support structure.

FIGS. 12 and 13 are front views of modified form of the molded support structure of the present invention as applied to a larger circuit breaker.

The function and operation of the molded casing support for a circuit breaker can best be understood from a preliminary description of a circuit breaker itself. The basic circuit breaker is that shown and described in U.S. Pat. No. 4,146,764 issued Mar. 27, 1979, U.S. Pat. No. 4,101,744 issued July 18, 1978 and U.S. Pat. No. 4,146,765 issued Mar. 27, 1979, and assigned to the assignee of the present application.

The circuit breaker and its arc chute structure and modified contact structure, are shown and described in application Ser. No. 869,857, filed contemporaneously herewith. The arc chute is more specifically shown and described in application Ser. No. 869,858, also filed contemporaneously herewith.

The following description (FIGS. 1 through 7) is included for the purpose of providing a recapitulation of the structure which is to be supported by the molded casing 210.

Figure 1:
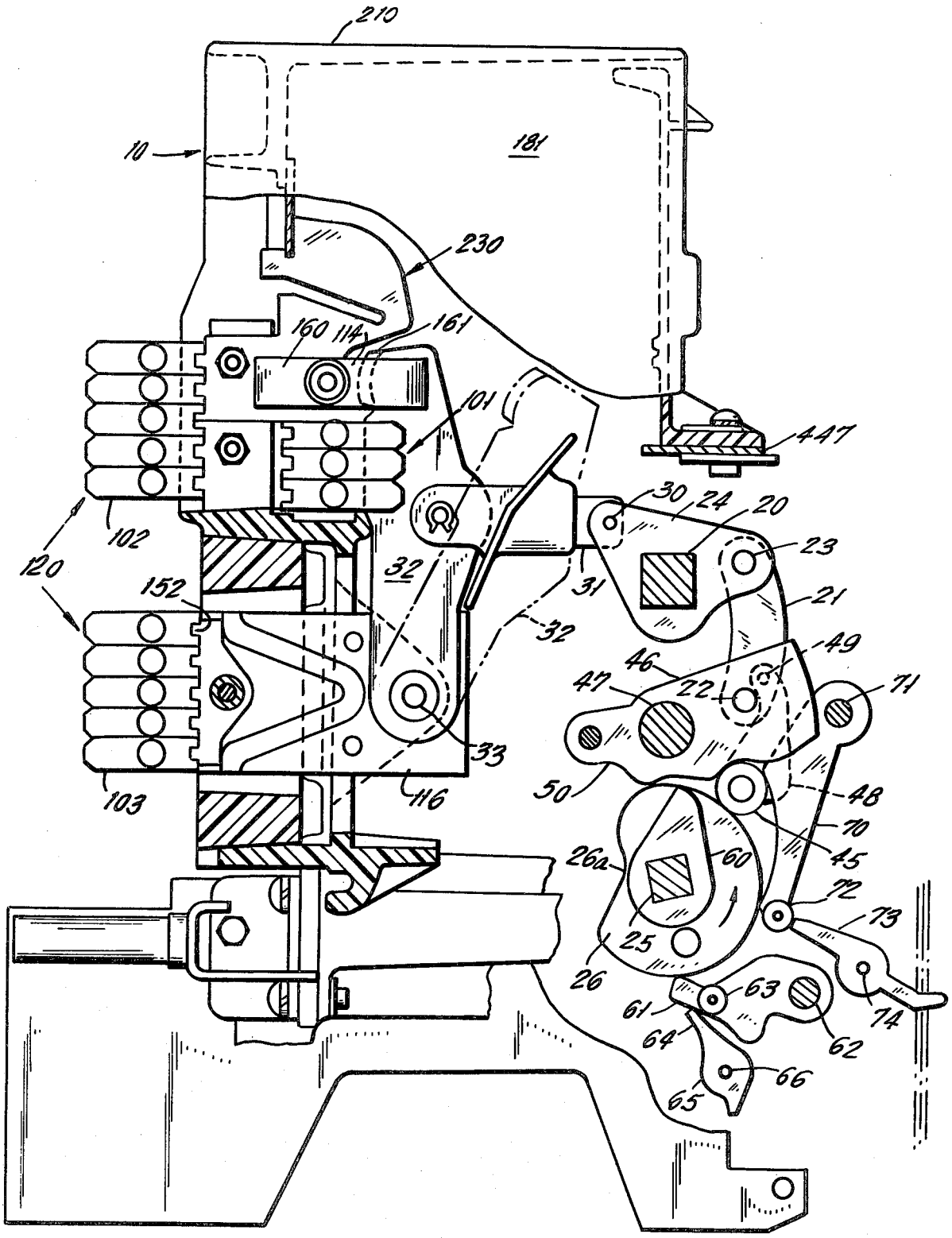
FIG. 1 is a schematic side view of the novel circuit breaker of the present invention showing one preferred arrangement of a contact member.

Referring first to FIG. 1, a circuit breaker is here shown schematically in the position in which the contacts are closed and the closing springs are fully discharged. The type of circuit breaker which is here referred to is fully described in patents assigned to the assignee of the present invention U.S. Pat. No. 4,146,764 issued Mar. 27, 1979, U.S. Pat. No. 4,101,744 issued July 18, 1978 and U.S. Pat. No. 4,146,765 issued Mar. 27, 1979), in which the basic circuit breaker to which this present application pertains is described in detail. The circuit breaker there described is a circuit breaker in which a plurality of closing springs are utilized to drive the circuit breaker from an open position to a closed position. Accordingly, a motor is provided which will first charge the springs and the springs are latched in the charged position. When the contacts of the circuit breaker are opened and are later to be closed, the latch which retains the closing springs in the charge position is released so that the springs may operate directly to close the contacts of the circuit breaker. After the contacts are closed, the springs may be recharged.

The present invention is directed to the circuit breaker structure itself and, in particular, the contact structure.

The spring charging structure and racking structure are therefore not specifically here described and the contact operating structure is described in connection with FIG. 1 to the extent only that it is necessary to understand the structure of the circuit breaker. The shaft 25 is driven counterclockwise in the direction indicated by the arrow in FIG. 1 in order to charge the closing springs. For this purpose, an appropriate connection from a motor or handle is made to the shaft 25 to perform the operation. On the closing of the circuit breaker, an appropriate latch as described in the said prior patents is set to prop the basic support members while nevertheless leaving the circuit breaker trip-free but arranging the circuit breaker so that it will not accidentally to opened by operation of closing springs upon recharge. The closing spring can be discharged only when the breaker is open.

The latch member 60 carried by shaft 25 is driven onto the prop latch 61 in a position not shown in FIG. 1 (but shown in FIG. 5*b* of the prior patents). The prop latch 61 is pivotally mounted on the stationary pivot 62 and is provided with the latch roller 63 which is supported by the closing latch 64. The closing latch 64 is an extension of the bell crank lever 65 which is pivoted on the stationary pivot 66. This latch structure provides a support for retaining the springs in charged condition while the contacts are open and after the contacts are closed preparatory to another closing operation.

In FIG. 1, the structure is shown in the condition in which the contacts are closed and the springs have been discharged; in other words, the closing latch 64 has been rotated so that it no longer supports the latch roller 63 and thus, no longer supports the prop latch 61 and thereby no longer supports the latch member 60 on the shaft 25 which latch member 60 has now rotated counterclockwise to the position where the springs have been discharged in order to close the circuit breaker. Therefore, the position shown in FIG. 1 is one in which the circuit breaker is closed and the springs are fully discharged.

As previously pointed out, the shaft 25 may be rotated in a counterclockwise direction to charge the springs, either by handle or motor, as described in the prior patents. Upon the discharge of the closing springs, which is the condition shown in FIG. 1, the shaft 25 is rotated to the position shown in FIG. 1, and the first cam 26 operates through roller 45 to rotate the third closing cam 46 in a counterclockwise direction around its pivot 47. The roller 45 on the arm 48 which is supported on the pivot 49 is a part of the cam 46. The end of the third closing cam 46 opposite to that which is engaged by the roller 45 is provided with a recess 50 which engages an additional roller related only to the spring closing operation, and described in the prior patents and need not be described here.

The second closing cam 70 is stationarily pivoted on the pivot 71 and is provided with the latch roller 72 which bears against the tripping latch 73 rotatably mounted on the pivot 74 and spring biased toward the position shown in FIG. 1. Thus, as the springs are charged, shaft 25 is rotated counterclockwise until member 60 is blocked by the prop latch 61. Member 60 is then in a position 180° opposite to the position shown in FIG. 1.

The prop latch 61 is in turn supported by the engagement of the latch roller 63 with the closing latch 64. This, again, is the condition when the closing springs are fully charged.

In the condition of the circuit breaker with the contacts open and the springs charged, the recess 26*a* of cam 26 on shaft 25 engages the roller 45. The roller 45 is driven up onto the outer perimeter of cam 26 thereby raising the lever 46 around its pivot 47 and following a path defined by the cam 26 and the second closing cam 70. The engagement of latch 73 with latch roller 72 establishes the position of cam member 70 and the track for roller 45 so that roller 45 is guided in a path which will lift the lever 46 around the pin 47. Link 21 connected at 22 to the lever 46 is connected at 23 to the bell crank arm 24 secured on the jack shaft 20. The opposite end of bell crank arm 24 is connected by pin 30 to the extension 31 of the contact arm 80. It will here be noted that the contact arm 80 is maintained in the closed position by the latch 73 engaging the roller 72 and positioning the roller 45 and arm 48 so that the lever 46 is maintained in the raised position to drive the bell crank lever 24 counterclockwise in the direction to maintain the contact arm 80 closed.

The contact elements forming the contacts 101, 102, 103 are arranged so that the main stationary contact elements 101 and the main disconnect contact elements 102, 103 are identical in construction thereby eliminating the total number of different parts which must be fabricated in order to construct the circuit breaker.

Figure 2:
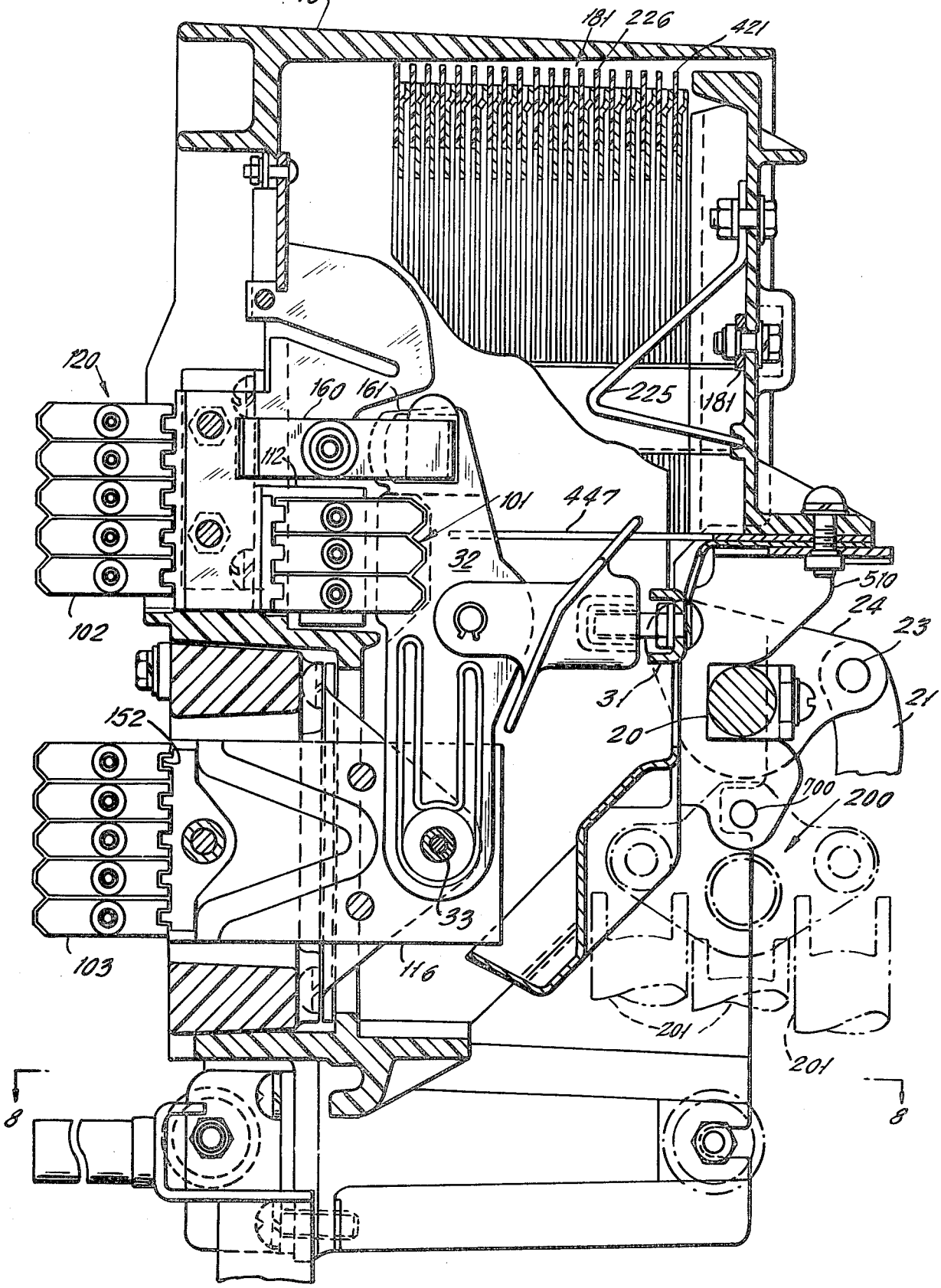
FIG. 2 is a side view partly in section corresponding to that of FIG. 1 showing in particular the stationary contact structure.

In the instance illustrated in FIGS. 1 and 2, the stationary contacts 101 are shown with three pairs of jaws while the disconnect contacts 102, 103 are shown with five pairs of jaws. The number of pairs of jaws utilized for the contact elements depends on the current rating and the desired current carrying capacity. Thus, in FIG. 4 which is a rear view of the circuit breaker, it will be shown that in the case of, for instance, an 800 ampere circuit breaker, three pairs of jaws may be used for the upper and lower disconnect contact. Should it be desired to use a 1600 ampere circuit breaker, then the same general structure may be utilized with five pairs of contact jaws for the upper and lower disconnect contact.

Should a larger capacity breaker be required, such as 2000 ampere breaker, then two sets of upper and lower disconnect contacts having five pairs of jaws each may be used for this purpose.

It should be noted in FIGS. 3, 4 and 5 while circuit breakers of different capacities are shown mounted in the three-pole structure, in any particular use, the circuit breaker structures for each of the poles should be the same in capacity. The showing of circuit breakers of three different capacities mounted in the three different sections of a single three-pole circuit breaker in FIGS. 3, 4, 5, 6 and 7 for the purpose of demonstrating that the same housing and the same structure may be utilized for circuit breakers of varying capacity, both in their operating capacity such as the 800 ampere, 1600 ampere, 2000 ampere breaker, as well as in current interrupting capacity.

As seen particularly in FIG. 5, current enters through the upper back connection stud 110 in the cubicle or stationary part of the circuit breaker housing. In the case of a higher capacity circuit breaker, where a plurality of sets of disconnect contacts can be required, the back connection structure or terminal may be modified as shown at 110*a*, 110*b* to provide a double support for the contacts. Similarly, for an even larger capacity circuit breaker carried by the same structure, a somewhat heavier back connection terminal or stud 110*c*, 110*d* may be utilized. Current then passes (FIGS. 1 and 2) through the disconnect contacts 102 to the stationary contact support structure 112, then through the stationary contacts 101 and the stationary arcing contact 114 to the movable contact arm or contact bridge 32 which is pivotally mounted at the pivot 33, on the lower connector and contact mounting structure 116.

Current then passes through the lower disconnect contacts 103 to the stationary terminal or stud 110 in the housing.

The disconnect contacts 102, 103 and the stationary contacts 101 are so arranged that they are identical in constructions so that each member of the pairs of jaws forming the plurality of contact elements is identical. This, therefore, simplifies the fabrication of the circuit breaker elements. Each of the individual elements 120 forming the various contacts 101, 102, 103 as shown in FIGS. 1, 2, 3, 5 and 6 is composed of a substantially elongated member having from the side view (visible more clearly in FIGS. 1 and 2), a substantially elongated rectangular appearance and, from the top or edge view, seen more particularly in the up-end FIGS. 5, 6, and 7, a plurality of curvatures designed to provide appropriate hinging contact pressure on the contact surfaces. Thus, as seen, for instance, in the bottom section of FIG. 5, each of the contact elements 120 is provided with a separable contact surface 121 adjacent the end 122 thereof. The end 122 thereof bends or flares flatly away from the contact surface 121 thereby providing a pivot with respect to which the contact members 120 will move. It should be noted that with respect to the disconnect contacts at the rear of the circuit breaker, as shown in the lower portion of FIG. 5, the pair of members 120 facing each other also have their contact surfaces 121 facing each other and the flare at the end 122 provides easy entry of the stationary cubicle stud 110*c* between the contacts surfaces 121 of the respective contacts elements 120. At the stationary circuit breaker contacts 101, the elements 120 are reversed so that the contact surface 121 of each of them is directed toward the blades 125, 125*a* of the movable bridge or contact 32. This, again, provides easy access of the contact elements 125, 125*a* through the flared section formed by the elements 122, 122 of the stationary contact elements 120 between the said contacts.

The members 120 extend in one direction on the circuit breaker toward the rear of the circuit breaker for easy connection to the stationary cubicle contacts 110 while they extend in the opposite direction on the circuit breaker toward the front of the circuit breaker for easy connection to the movable contact structure 32.

Each of the members 120 is provided with an opening 130, 130 through which a bolt 131 may be passed and a nut 132 on the bolt 131 compresses spring 133 in order to provide appropriate contact pressure between the contact surfaces 121, 121 of members 120, each of which is being driven toward the other. The bolt 131 also serves to mount the contact structure for the stationary contact of the circuit breaker on the connection member or circuit breaker internal bus 112; opening 135 is provided at the forward or right-hand end of the circuit breaker internal bus 112 (see FIG. 5), so that the bolt 131 may pass therethrough and secure the contacts in place. Similarly, at the rear end of the internal bus 112 of the circuit breaker, an opening 136 is provided for the rear bolt 131 in order to secure the contact members for the disconnect contacts 102 in place.

It will be noted that each of the contact members 120 is provided with an outwardly directed bend or boss 140 at the point where the bolt 131 passes through the same and that the contact elements 120 are so curved that the compression spring between them forces the contact sections 121 toward each other and also forces the stationary contact sections 142, 142 toward each other.

By this means, therefore, and for instance, the upper stationary internal bus 112 of the circuit breaker is connected with the rear disconnect contact structure 103 by the engagement of contact surfaces 142, 142 of the facing contact members 120, 120 with the internal circuit breaker bus 112.

The contact members 120, 120 being driven toward each other by the compression spring 133 not only drive the contact surfaces 142, 142 into engagement with the internal circuit breaker bus 112, but also drive the contact surfaces 121, 121 of the contacts 120 toward each other in order to establish appropriate contact with the stationary or cubicle stud 110.

The flare provided by the bending out of the ends 122 at each end makes it possible when the circuit breaker is inserted into the cubicle for the contact surfaces 121, 121 of the contact 120 facing toward the rear to be spread apart by the chamfered end 150 of the stationary stud 110 to enter upon the surface of the stud 110 on each side and the compression spring establishes appropriate contact.

Similarly, in the reverse condition of the contact elements 120, the stationary circuit breaker contacts 101 operate in the same manner so that the blades 125, 125*a* may enter between the contact surfaces 121, 121.

For ease in assembly of the circuit breaker contact and in order to avoid misalignment during assembly, as seen particularly in FIGS. 1 and 2, and also in the lower end of FIG. 5, the contact members 120 are notched at their rear or "stationary" end at the notch 152 to indicate readily which part of the contact structure is to be stationarily and permanently secured to the contact carrying member.

In addition to the stationary contacts 101 described in connection with FIGS. 1, 2 and 5, the circuit breaker upper connection bus 112 carries an additional pair of arcing contacts 160 which engage with the arcing contact section 161 of the contact bridging arm 80. This arcing contact section is more readily seen in the upper right-hand and center poles of FIG. 5 wherein the stationary arcing contact 160 operates in substantially the same manner as one of the elements 120 of the main contact 101 or disconnect contacts 102, 103, except that it is larger and is made of material better able to withstand the arc.

The stationary arcing contact 160 comprises two identical contact members 162, which are arranged to face each other and have at the end thereof, facing the movable contact arm, arcing contact elements 163, 164. The opposite end of the arcing contact members 162 are provided with contact surfaces 165, 165, which engage the upper internal bus 112 of the circuit breaker leading to the upper disconnect contact section 102.

An opening in the upper 167 internal bus 112 of the circuit breaker carries the bolt 170 which passes also through appropriate openings in the arcing contact elements 162, and positions a compression spring 171, 172 on each side against the arcing contact elements 162, thereby driving them toward each other and against the movable arcing contacts 161, 161, carried by the contact bridging arm 32.

As is well known in the circuit breaker art, and as may be seen, particularly from FIGS. 1 and 2, the length of the stationary arcing contact 160, and the arrangement of parts is such that, when the movable contact arm 32 moves from the solid line position of FIG. 1 to the dotted line position of FIG. 1, current is transferred from the stationary main contact 101 to the stationary arc contact 160. This is so because the separation of the movable contact arm 32 and the stationary circuit breaker contact 101 occurs first.

The arc is then drawn between the arcing contact elements 163 and 161 and is then moved up into the arc chute 181 where it is extinguished.

In FIG. 2, the circuit breaker mechanism including the shaft 20 which operates the moving contact arm 32, is shown as well as the operating link 21. There is also indicated at 200 the elements related to the spring charging mechanism for the charging of the springs 201, 201. No specific description of this structure is herein contained because it is described in the patents previously mentioned (U.S. Pat. No. 4,146,764 issued Mar. 27, 1979, U.S. Pat. No. 4,101,744 issued July 18, 1978 and U.S. Pat. No. 4,146,765 issued Mar. 27, 1979). Parts which are therein fully described require no further description here. Since the present invention relates to the circuit breaker molded housing, only those parts of the circuit breaker which are necessary for an understanding of the relation of the housing to the breaker are here specifically described.

The molded casing 210 (see FIGS. 8 and 9) comprise a top wall, a side wall 502, side wall 503 and a back wall 504. A plurality of compartments are provided, including the compartment 461 for the arc chute 181, by the utilization of the vertical walls 507 and 508. The vertical walls 507, 508 cooperate with the side walls 502, 503 to provide the three upper compartments which will support the stationary contact mechanism consisting of the stationary contact 101 and the bus 112 to which they are connected, as well as the stationary arc runner 230.

The arc extinguisher 181 may be received and mounted in each of the compartments 461, 505, 506, being secured thereto in the manner already described in connection with FIGS. 1 to 7 and resting on the shelf 447. Shelf 447 may be secured in any suitable manner between the side walls 502 and 503 and is preferably a metal shelf for structural support which not only serves to support the various arc chutes 181, 181, but also provides a support from which other operating mechanisms might be hung.

As seen in FIG. 5, vertical walls 507 and 508 are provided with molded in inserts 605 and 606. Bearing blocks 510, 510 are attached to the inserts by screws 603, 604. Jackshaft 20 is supported by bearing blocks 510, 510. The shelf 447 is also attached to these bearing blocks. Likewise, the mechanism is pinned to the bearing blocks by pin 700 of FIG. 2. The members 510, 510, support the jackshaft 25 which is driven by the bell crank lever 412 and the operating mechanism including the opening springs 411.

Each of the side walls 503, 502 and each of the intermediate walls 507, 508, are provided on the surfaces which face the compartments 461 with recesses 480 for the arc chute 181 when the arc chute is inserted therein. When the arc chute is thus inserted, it may rest directly on the shelf 447. The structure may be arranged as shown in the modified form of FIG. 10 wherein the arc chute may be supported on rails 520, 520. As a further alternative, the arc chute may in part be supported on the short integral framework shelf 521 of FIG. 11. The mechanism which is hung from the bearing blocks 510 may also be in part supported by the lower section of molding 710.

In FIG. 11, the combination of a shelf 521 and a rail **520*a* and rail 530*a*** is also shown for alternative support.

FIG. 12 differs essentially from the structure of FIG. 10 in that it shows provision for a circuit breaker having double width poles so that wider arc chute structures and wider contact and mechanism structures may be inserted. This is also true of the structure of FIG. 13 wherein the shelves may be used in conjunction with the rails **520*b* and 530*b***.

As is shown in FIG. 12, the integral shelves may be omitted when the rails **520*c* and 530*c*** are used.

The frontpanel 600 of the circuit breaker is shown partly removed from the mechanism. This front panel corresponds in general function and in operation to the structure shown in U.S. Pat. No. 4,146,764 issued Mar. 27, 1979, U.S. Pat. No. 4,101,744 issued July 18, 1978 and U.S. Pat. No. 4,146,765 issued Mar. 27, 1979. The breaker support member 410 which also supports the circuit breaker mechanism and supports the molded casing or housing 210 is secured to the housing in a suitable manner as by the plate 610 and the bolts 611, 611, entering the molded housing as well as the bolts 612, 612, entering the sides 615 of member 410. The member 410 is the basic support for the circuit breaker structure including the molded housing 210. It will be seen that the rear wall 504 of the molded housing 210 acts as a support primarily for the disconnect contacts 102, 103, which are mounted on their respective circuit breaker buses 112 and 116.

The walls 711 of the upper chamber 461 act as protective panels in order to shield the operative parts of the circuit breaker from the connecting elements in the cubicle. Similarly, the walls 620 of the lower section of the molded housing 210 serve to shield the operating mechanism and the elements connected thereto from the lower stationary connecting elements in the cubicle.

As will be readily understood, the walls 507, 508, serve as integral interphase barriers between the poles of the circuit breaker. Similarly, the rear partitions 640, 641, 642, 643, act as interphase barriers at the rear of the circuit breaker. The element 650 shown in FIG. 9 is part of the racking mechanism which cooperates with a member in the cubicle in order to permit the circuit breaker to be racked in and out of the cubicle.

As will be seen from FIG. 8, as well as from FIG. 3, the cubicle cooperates with the arc extinguisher 181 in that the element 460, 460, at the top of the housing sections 461 for the arc chutes serve first to contain the arc gases and then to guide the arc gases down the side of the arc chute, thereby providing a place for the arc gases to go and be dissipated and making it unnecessary to provide a superstructure for the arc chute. The molded structure including the side walls of the housing 461 and the curved top walls 460 thus provide an appropriate baffle arrangement for the arc gases.

FIGS. 12 and 13 show structures essentially similar to the structures shown in FIGS. 8 to 11, except for the fact that they may receive higher capacity current carrying parts. The recesses are made double width so that two arc chutes may be used for a pair of spaced bridging contacts or for separate sets of contacts for each pole, and two curved guides or baffles may be used alongside and between the arc chutes in order to provide appropriate baffling and redirecting of the arc gases without requiring a superstructure for the circuit breaker.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. In combination, a unitary housing of insulating material for a high capacity multipole circuit breaker; each pole of said circuit breaker having a stationary contact structure and a first disconnect contact structure connected to said stationary contact structure, a stationary arcing contact structure, an arc extinguishing structure located at and above the stationary arcing contact structure and the stationary contact structure, a second disconnect contact structure and a movable bridging contact connected to said second disconnect contact structure, operating means for moving said movable bridging contact into and out of engagement with said stationary contact structure;

said unitary housing comprising a vertical back wall; said disconnect contact structures of each pole being supported by and extending through said back wall;

a vertical interphase wall perpendicular to said back wall and located between adjacent pole positions for said circuit breaker;

a top wall extending across all the pole positions of said circuit breaker;

vertical side walls at the outer ends of the housing parallel to the vertical interphase walls;

a support at each pole position for said arc extinguishing structure; said top wall and each adjacent pair of walls perpendicular to said back wall defining a recess for receiving said arc extinguishing structure;

said arc extinguishing structure being vented at the top thereof adjacent said top wall;

said top wall having interior guiding surfaces adjacent the top of the arc extinguisher structure directing arc gases toward said pair of walls defining said recess.

2. The combination of claim 1 wherein said interior guiding surfaces of said top wall constitute curved baffles directing arc gases toward said pair of walls defining said recess.

3. The combination of claim 2 wherein said arc extinguisher structure, when in position in said recess, is spaced from the said pair of walls defining said recess to provide a passage for arc gases directed thereto by the curved baffles of said topwall.

4. The combination of claim 3 wherein the housing is adapted to receive and position circuit breaker and arc extinguishing structure elements of different size and capacity.

5. The combination of claim 1 wherein the housing is provided with a transverse shelf parallel to the top wall and extending from one side wall to the opposite side wall.

6. The combination of claim 3 wherein each of the recesses are provided for receiving said arc extinguishing structure and each recess has means for supporting the arc extinguisher structure therein.

7. The combination of claim 5 wherein the housing also provides structural supports for said circuit breaker operating means.

8. The combination of claim 7 wherein each disconnect contact structure includes a bar extending through the back wall;

and wherein the housing also has additional integral vertical interphase walls between the portion of the disconnect contact structures of adjacent poles extending through the back wall from the side opposite the portion of said wall of the housing at which the circuit breaker contacts, operating means and arc extinguishing structure are positioned.

9. The combination of claim 8 wherein said additional interphase walls are aligned with said first-mentioned interphase walls and said side walls extend on both sides of said back wall.

* * * * *